US009291962B2

(12) United States Patent
Yamanaka et al.

(10) Patent No.: US 9,291,962 B2
(45) Date of Patent: Mar. 22, 2016

(54) IMAGE-FORMING APPARATUS WITH CONTROLLER AND FIXING PORTION TO CONTROL TONER ADHESION AMOUNT

(71) Applicant: Konica Minolta, Inc., Chiyoda-ku, Tokyo (JP)

(72) Inventors: Daiki Yamanaka, Kanagawa (JP); Toru Yamaguchi, Tokyo (JP); Takashi Harashima, Kanagawa (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/604,062

(22) Filed: Jan. 23, 2015

(65) Prior Publication Data

US 2015/0227093 A1 Aug. 13, 2015

(30) Foreign Application Priority Data

Feb. 13, 2014 (JP) ..... 2014-025558

(51) Int. Cl.
*G03G 15/00* (2006.01)
*G03G 15/20* (2006.01)

(52) U.S. Cl.
CPC ..... *G03G 15/2039* (2013.01); *G03G 15/5062* (2013.01)

(58) Field of Classification Search
CPC ..... G03G 15/2039; G03G 15/5062
USPC ..... 399/15, 67–69
See application file for complete search history.

(56) References Cited

U.S. PATENT DOCUMENTS 8,190,046 B2 * 5/2012 Kataoka et al. ..... 399/67

FOREIGN PATENT DOCUMENTS

JP 2006171104 A 6/2006
JP 2007199466 A 8/2007

* cited by examiner

*Primary Examiner* — William J Royer
(74) *Attorney, Agent, or Firm* — Cantor Colburn LLP

(57) ABSTRACT

In an image-forming apparatus such as a printer, a controller judges whether or not a determination processing of fixity saturation state is performed to determine a fixing condition in which an image density of a patch is the fixity saturation state. The controller then performs the determination processing of fixity saturation state when a use condition is changed. The controller settles fixing conditions in which the image density of patch is highest as the set value when the image density of the patch is saturated. Next, the controller performs a toner adhesion amount adjustment using an intermediate transfer belt. A target value of the toner adhesion amount on the intermediate transfer belt corresponding to the target image density is set and then, an optimal developing voltage that is the set target value is set. After the toner adhesion amount adjustment, the controller performs fixity adjustment.

9 Claims, 11 Drawing Sheets

IMAGE-FORMING APPARATUS WITH CONTROLLER AND FIXING PORTION TO CONTROL TONER ADHESION AMOUNT

CROSS REFERENCE TO RELATED APPLICATION

The present invention contains subject matter related to Japanese Patent Application No. JP 2014-25558 filed in the Japanese Patent Office on Feb. 13, 2014, the entire contents of which being incorporated herein by reference.

BACKGROUND OF THE INVENTION

1. Technical Field

The present invention relates to an image-forming apparatus that forms an image on a sheet.

2. Background Art

An image-forming apparatus adopting an electrophotographic system such as a printer, a copier, a facsimile and the like has been widely used in the past. Such an image-forming apparatus has formed toner images of respective colors of yellow, cyan, magenta and black on photoreceptors corresponding to each color and then, it has transferred these toner images on an intermediate transfer belt with overlapping them in order. The image-forming apparatus has transferred the transferred toner images on a sheet being transported at once to form a color image.

In the image-forming apparatus, it has been desirable to keep a toner adhesion amount stable in order to maintain stable an image density of the toner image on the sheet. For that purpose, in the image-forming apparatus, a sensor has detected a toner adhesion amount of a patch, which is a toner image for a test and is formed on an image carrier such as the intermediate transfer belt. Based on this detection result thereof, the image-forming apparatus has controlled the toner adhesion amount of the image by adjusting any image-forming conditions such as charged voltages and developing bias voltages.

The image-forming apparatus may generate any failure in the image density by changing, for example, any image-forming conditions in a transfer portion, any fixing conditions in a fixing portion and/or the like. Accordingly, in recent years, an image-forming apparatus has been developed in which an image density sensor is provided at a downstream side of the fixing portion and the toner adhesion amount is controlled on the basis of an output of this image density sensor to attain stability in the image density.

Each of Japanese patent application publications Nos. 2007-199466 and 2006-171104 discloses the image-forming apparatus which has any faculty to attain stability in the image density. For example, Japanese patent application publication No. 2007-199466 discloses the image-forming apparatus which can keep an output image density stable by controlling a target value of the toner adhesion amount according to a fixing temperature, a fixing speed and species of sheet. On the other hand, Japanese patent application publication No. 2006-171104 discloses the image-forming apparatus which adjusts the image density by the developing bias and then, adjusts glossiness by the fixing temperature with adding image density value thereto.

SUMMARY OF THE INVENTION

Issues to be Addressed by the Invention

However, since a variation in the image density based on the variation in the fixity is adjusted by the toner adhesion amount in the image-forming apparatus disclosed in each of Japanese patent application publications Nos. 2007-199466 and 2006-171104, the following may occur: Namely, when the fixity of the fixing portion such as the fixing temperature or pressure (nipping pressure) is excessive or insufficient based on a variation in use conditions such as exchange of the fixing portion, an individual difference in durability of the fixing portion and the like, the image density may also vary together with such a variation. In each of Japanese patent application publications Nos. 2007-199466 and 2006-171104, since the toner adhesion amount is adjusted on the basis of the variation in the image density based on the variation in the fixity thereof, the toner adhesion amount may be excessive or insufficient. As a result thereof, when the toner adhesion amount is excessive in the image, this may generate any failures in fixing separation and/or in cleaning. When the toner adhesion amount is insufficient in the image, this may generate any various kinds of failure in density unevenness, deterioration of graininess and the like.

Means for Solving the Issues

This invention addresses the above-mentioned issues and has an object to provide an improved image-forming apparatus.

To achieve the above-mentioned object, an image-forming apparatus reflecting one aspect of this invention contains an image-forming portion that forms a patch on a sheet, the patch being a toner image, a fixing portion that fixes the patch formed by the image-forming portion on the sheet, an image-density-detecting portion that detects an image density of the patch fixed by the fixing portion on the sheet, and a controller that controls the fixing portion to control a toner adhesion amount based on a detection result of the image density of the patch by the image-density-detecting portion, wherein the controller sets a fixing condition of the fixing portion in the control so that the image density of the patch is saturated and controls the fixing portion to control the toner adhesion amount based on the detection result of the image density of the patch by the image-density-detecting portion, the patch being formed under the set fixing condition.

It is desirable to provide an image-forming apparatus wherein the controller controls the fixing portion to fix plural patches under different fixing conditions, and sets as a set value of the fixing condition in which the image density of the patch is saturated a fixing condition in which the image density is highest or approximate to the highest value of the plural patches detected by the image-density-detecting portion.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe configuration examples of the image-forming apparatus as preferred embodiments relating to the invention with reference to drawings. It is to be noted that the description in the embodiments is exemplified and any technical scope of the claims and/or meaning of term(s) claimed in the claims are not limited thereto.

First Embodiment

[Configuration Examples of Image-Forming Apparatus]

The following will describe an image-forming apparatus 100 according to the first embodiment of the invention. The image-forming apparatus 100 performs a toner-adhesion-amount-controlling process (hereinafter, also referred to as "toner-adhesion-amount-controlling mode") in a situation where an image density of a patch is saturated and prevents a variation in the image density based on a variation in the fixity to accomplish an accurate control of toner adhesion amount adjustment.

Figure 1:
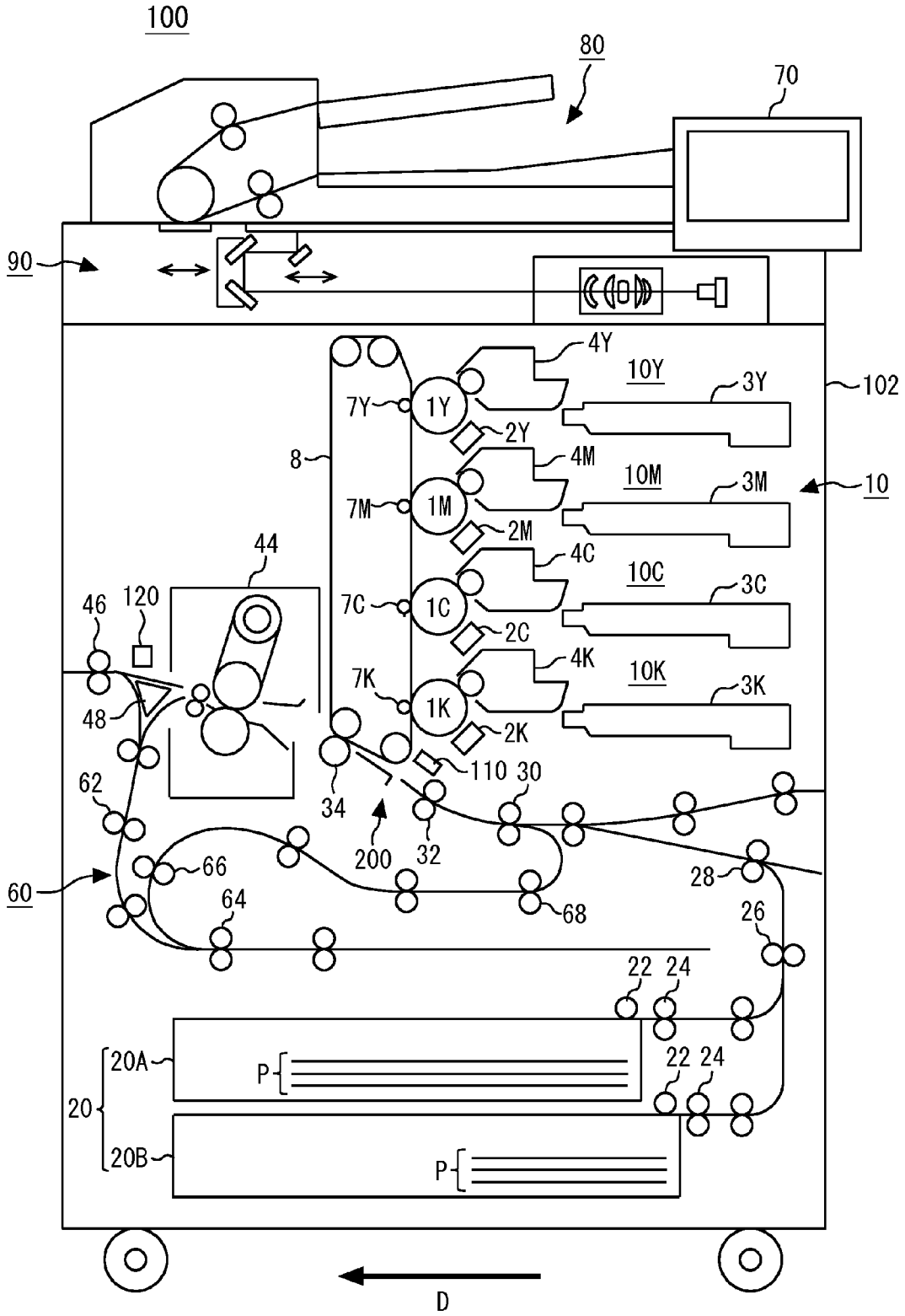
FIG. 1 is a diagram showing a configuration example of an image-forming apparatus according to a first embodiment of this invention.

FIG. 1 shows a configuration example of the image-forming apparatus 100 according to the first embodiment of this invention. As shown in FIG. 1, the image-forming apparatus 100 is an image forming apparatus called an "tandem type image-forming apparatus". The image-forming apparatus 100 contains an automatic document feeding portion 80 and an apparatus main body 102. The apparatus main body 102 mounts the automatic document feeding portion 80. The automatic document feeding portion 80 feeds sheets set on a document table to an image-reading portion 90 of the apparatus main body 102 using conveying rollers and the like.

The apparatus main body 102 contains a manipulation/display portion 70, the image-reading portion 90, an image-forming portion 10, an intermediate transfer belt (image carrier) 8, an image density control (IDC) sensor 110, a feeder 20, a register unit 200, a fixing portion 44, an image density sensor 120 and an auto duplex unit (ADU) 60.

The manipulation/display portion 70 contains a touch panel in which a manipulation part and a display unit are combined, and various kinds of operation keys such as determination keys, a start key and the like, which surround the touch panel. The manipulation/display portion 70 displays a menu screen or the like on its screen and receives any information about the image-forming conditions and the fixing conditions input by a user through a touch operation on the menu screen and/or an operation of the operation keys.

The image-reading portion 90 scans and exposes the document mounted on the document table or the document fed by the automatic document feeding portion 80 using an optical system in a scanning and exposure device. The image reading portion 90 also performs photoelectric conversion on a scanned image of the document by a charge-couple device (CCD) image sensor to obtain an image information signal. The image-processing portion, not shown, then performs a predetermined processing such as an analog processing, analog-to-digital (A/D) conversion processing, a shade correction, image compression processing and the like on this image information signal and outputs it to the image-forming portion 10.

The image-forming portion 10 forms an image based on an electrophotographic method. The image-forming portion 10 includes an image-forming unit 10Y which forms a yellow (Y) image, an image-forming unit 10M which forms a magenta (M) image, an image-forming unit 10C which forms a cyan (C) image, an image-forming unit 10K which forms a black (K) image and secondary transfer roller (transfer portion) 34. In this embodiment, in order to indicate a color relative to common function or name, Y, M, C or K will be attached to the number of the common function or name, for example, 10Y, 10M, 10C and 10K.

The image-forming unit 10Y includes a photosensitive drum (image carrier) 1Y, a charging portion 2Y arranged around the photosensitive drum 1Y, a writing (exposure) portion 3Y and a developing portion 4Y. The image-forming unit 10M includes a photosensitive drum (image carrier) 1M, a charging portion 2M arranged around the photosensitive drum 1M, an exposure portion 3M and a developing portion 4M. The image forming unit 10C includes a photosensitive drum (image carrier) 1C, a charging portion 2C arranged around the photosensitive drum 1C, an exposure portion 3C and a developing portion 4C. The image forming unit 10K includes a photosensitive drum (image carrier) 1K, a charging portion 2K arranged around the photosensitive drum 1K, an exposure portion 3K and a developing portion 4K.

The respective photosensitive drums (image carriers) 1Y, 1M, 1C and 1K, the respective charging portions 2Y, 2M, 2C and 2K, the respective exposure portions 3Y, 3M, 3C and 3K and the respective developing portions 4Y, 4M, 4C and 4K of the image forming units 10Y, 10M, 10C and 10K have the same configuration as each other. They will be indicated in the following description with Y, M, C and K being omitted except for a case in which any distinction thereof is required.

Each of the charging portions 2 uniformly charges static charges around a surface of each of the photosensitive drums 1. Each of the exposure portions 3 contains an LED print head (LPH) including an LED array and an image-formation lens, and a laser scanning and exposure apparatus with polygon mirror system. Each of the exposure portions 3 scans each of the photosensitive drums 1 by laser light based on the image information signal to form electrostatic latent images on each of the photosensitive drums 1. Each of the developing portions 4 develops the electrostatic latent images formed on each of the photosensitive drums 1 using toners. Thus, a toner image that is a visible image is formed on each of the photosensitive drums 1.

The intermediate transfer belt 8 is an endless belt. The intermediate transfer belt 8 runs on plural rollers with it being stretched and supported by them. Together with the rotation of the intermediate transfer belt 8, each of primary transfer rollers 7 (7Y, 7M, 7C, 7K) and each of the photosensitive drums 1 rotate. When applying a predetermined electric voltage between each of the primary transfer rollers 7 and each of the photosensitive drums 1, the toner image formed on each of the photosensitive drums 1 is transferred on the intermediate transfer belt 8 (Primary Transfer). A patch which is a toner image is transferred on the intermediate transfer belt 8 in a toner-adhesion-amount-controlling mode.

The IDC sensor 110 constitutes an adhesion amount detection portion and is arranged under the photosensitive drum 1K so as to be faced to the intermediate transfer belt 8. The IDC sensor 110 is provided with, for example, light-emitting device as a source of light and a light-receiving device and irradiates light from the light-emitting device to the intermediate transfer belt 8 to receive any light reflected by an image (patch) on the intermediate transfer belt 8 using the light-receiving device. The IDC sensor 110 outputs a voltage value based on an amount of received light as a detection value indicating the toner adhesion amount.

The feeder 20 has plural feeding trays 20A, 20B each containing sheets P with a size such as A3, A4 or the like. The feeder 20 feeds the sheets P one by one from the selected feeding tray 20A or 20B and conveys the fed sheet P to the register unit 200 through conveying rollers 22, 24, 26 and 28 and the like. It is to be noted that numbers of the feeding trays are not limited to two. A single or plural large capacity sheet feeder(s), which can contain a large number of sheets P, may be connected to the image-forming apparatus 100 depending on the situation.

The register unit 200 includes a pair of loop-forming rollers 30 and a pair of registration rollers 32. The pair of loop-forming rollers 30 hits a forward end of the sheet P conveyed by the register unit 200 to the pair of registration rollers 32 to form a loop so that a skew (inclination) of the sheet P in relation to a sheet-feeding direction of the sheet P is corrected. The pair of registration rollers 32 conveys the sheet P, the skew of which is corrected, to the secondary transfer rollers 34 at desired timing. The secondary transfer roller 34 transfer toner images of colors Y, M, C and K transferred on the intermediate transfer belt 8 altogether to a surface of the sheet P fed by the pair of registration rollers 32 (Secondary Transfer). The secondary transfer rollers 34 then conveys the sheet P on which the secondary transfer is formed to the fixing portion 44 that is arranged at a downstream side along the sheet-feeding direction of the sheet P.

The fixing portion 44 contains pressure rollers and heating rollers. The fixing portion 44 fixes the toner images transferred on the surface of the sheet P to the sheet P by applying pressure to the sheet P to which the secondary transfer roller 34 has transferred the toner images and heating the same.

Figure 2:
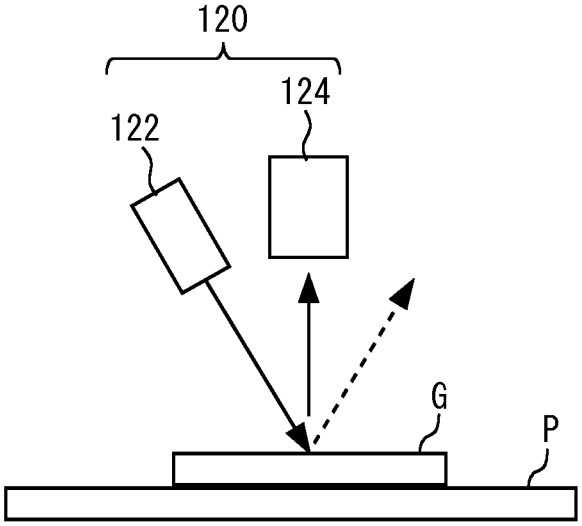
FIG. 2 is a diagram showing a configuration example of an image density sensor.

The image density sensor 120 constitutes image-density-detecting portion. The image density sensor 120 is arranged at a downstream side of the fixing portion 44 along the sheet-conveying direction. The image density sensor 120 measures image density of the patch which is the toner image fixed on the sheet P. FIG. 2 shows a configuration example of the image density sensor 120. As shown in FIG. 2, the image density sensor 120 contains a source of light 122 and a light-receiving portion 124. The source of light 122 irradiates light to a fixed patch G on the sheet P. The light-receiving portion 124 receives diffused light that is reflected on the patch G and outputs as an image density value the voltage value based on the received light.

A conveying path changeover portion 48 is provided at the downstream side of the fixing portion 44 along the sheet-feeding direction. The conveying path changeover portion 48 performs changeover control of the conveying path based on a selected printing mode (single surface printing mode or duplex printing mode).

Ejection rollers 46 eject onto a sheet-ejection tray, not shown, the sheet P, a single surface of which has been printed in the single surface printing mode or both surfaces of which have been printed in the duplex printing mode.

When re-feeding the sheet P, a surface side of which has been printed, to the image forming portion 10 during the duplex printing mode in order to form an image on a rear surface of the sheet P, the sheet P is conveyed to ADU 60 via the conveying path changeover portion 48. Conveying rollers 62 and the like convey the sheet P, which is conveyed to the ADU 60, to a switchback route. In the switchback route, ADU rollers 64 perform a reverse rotation control on the sheet P to convey the sheet P to a U-turn path with a rear end of the sheet P being lead. Conveying rollers 66, 68 and the like provided in the U-turn path re-feed the sheet P to the pair of registration rollers 32 while front and back of the sheet P is reversed.

[Configuration Example of Image-Forming Apparatus]

Figure 3:
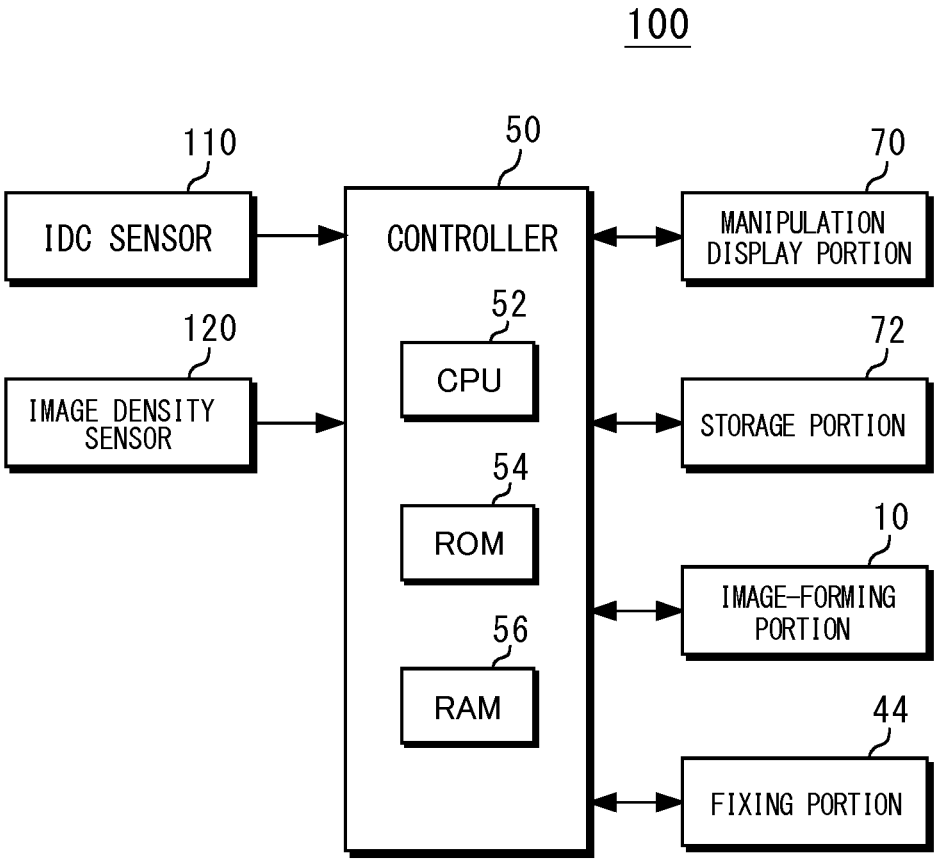
FIG. 3 is a block diagram showing a configuration example of the image-forming apparatus according to the first embodiment of this invention.

The following will describe a configuration example of the image-forming apparatus 100 according to the first embodiment of the invention with reference to FIG. 3. As shown in FIG. 3, the image-forming apparatus 100 contains a controller 50 that controls operations of the whole image-forming apparatus 100. The controller 50 includes a central processing unit (CPU) 52, a read only memory (ROM) 54 and a random access memory (RAM) 56. The CPU 52 carries out software (programs) read out of the ROM 54 to control each portion of the image-forming apparatus 100 to realize any functions relating to the toner-adhesion-amount-controlling mode and the image-forming processing.

To the controller 50, the manipulation/display portion 70, a storage portion 72, the image-forming portion 10, the fixing portion 44, the IDC sensor 110 and the image density sensor 120 are respectively connected. The manipulation/display portion 70 displays the menu screen or the like on its screen based on a display signal or the like received from the controller 50 and produces a manipulation signal based on input information received by the menu screen or the like and/or input information by the manipulation keys to output it to the controller 50.

The storage portion 72 includes a nonvolatile semiconductor memory, hard disk drive (HDD) and the like. The storage portion 72 stores a table storing a plurality of the fixing temperatures, the developing voltages and the like, which are used when performing the toner-adhesion-amount-controlling mode, set values indicating the fixing conditions so that the patch is the fixity saturation state thereof, and the like.

The image-forming portion 10 forms the patch which is a toner image for controlling the toner adhesion amount or the like on the intermediate transfer belt 8 based on any control information received from the controller 50. The fixing portion 44 adjusts the fixing temperature of the heating rollers, pressure (nip pressure) by the pressure rollers and a transporting speed of the sheet P (rotation speed of the rollers) when the sheet P is passed through the fixing portion 44, based on any control signals received from the controller 50.

The IDC sensor 110 irradiates the light based on any control signals received from the controller 50 and outputs to the controller 50 the voltage value based on the toner adhesion amount of the patch, which is detected in the measurement. The image density sensor 120 irradiates the light to the patch based on any control signals received from the controller 50 and outputs to the controller 50 the voltage value based on the toner adhesion amount of the patch, which is detected in the measurement.

[Example of Relationship Between Image Density and Fixing Temperature]

Figure 4:
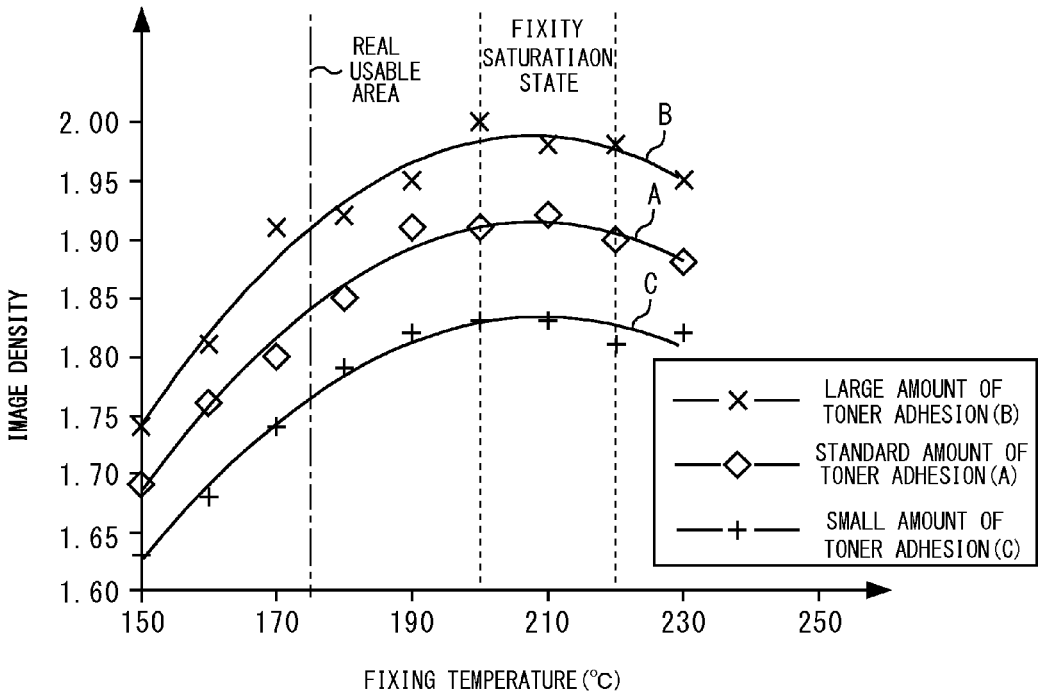
FIG. 4 is a graph showing a relationship between a fixing temperature and the image density in a fixing processing.

FIG. 4 shows the relationship between the fixing temperature and the image density in the fixing processing. The vertical axis thereof indicates the image density and the horizontal axis thereof indicates the fixing temperature. In FIG. 4, a case A is shown in which the toner adhesion amount to the patch is set to become a standard amount; a case B is shown in which the toner adhesion amount to the patch is set to become a large amount; and a case C is shown in which the toner adhesion amount to the patch is set to become a small amount. The following will describe the case A in which the toner adhesion amount to the patch is set to become the standard amount, as the representative example.

As shown in FIG. 4, when the temperature increases, the image density of the patch on the sheet P also increases. In this embodiment, in the standard image-forming process, the fixing temperature in the real usable area is, for example, about 175° C. When the temperature further increases, the image density is highest at the fixing temperature of, for example, 210° C., in which the image density is saturated. The temperature area near the highest value of the image density is also a saturation area in which the image density is not almost changed even when the fixing temperature (fixing condition) is changed.

In this embodiment, a state in which the image density is not almost changed even when the fixing condition (fixity) is changed is referred to as a "fixity saturation state". In other words, in the fixity saturation state, an inclination of the image density with respect to the fixing temperature is smaller than that of the real usable area. Specifically, when the image density is highest at the fixing temperature of 210° C., the fixity saturation state appears at the temperature area between 200° C. and 220° C. around the fixing temperature of 210° C. Further, the temperature area in which the fixity saturation state appears may be set so as to be a narrower or broader area than the above-mentioned temperature area if it is within a range having a fixed fluctuation band.

On the other hand, when the fixing temperature still further increases and exceeds the fixing temperature area in which the fixity saturation state appears, the fixing temperature is excessive so that the toner is separated from the sheet to generate any failure in image such as off-set and a decrease in image density. It is to be noted that in cases B and C of the toner adhesion amounts, although the image densities are different from that of the case A in the toner adhesion amount, their output shapes of the toner adhesion amount are almost the same shapes as that of the case A.

[Example of Relationship Between Image Density and Toner Adhesion Amount]

Figure 5:
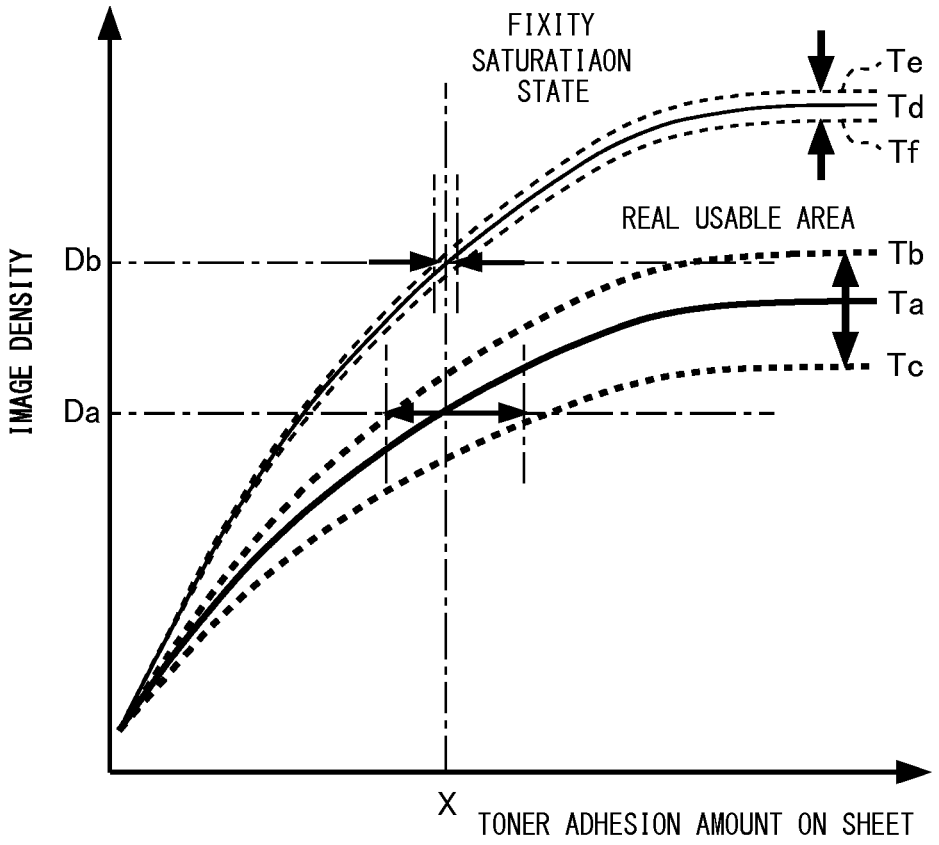
FIG. 5 is a graph showing a relationship between the fixing temperature and a toner adhesion amount in the fixing processing.

FIG. 5 shows the relationship between the fixing temperature and the toner adhesion amount in the fixing processing. The vertical axis thereof indicates the image density and the horizontal axis thereof indicates the toner adhesion amount on the sheet. In FIG. 5, a thick solid line indicates a case where the fixing condition is set to be Ta within the real usable area and thick dotted lines indicate cases where the fixing conditions are changed to Tb and Tc within the real usable area. A fine solid line indicates a case where the fixing condition is set to be Td within the fixity saturation state and fine dotted lines indicate cases where the fixing conditions are changed to Te and Tf within the fixity saturation state.

As shown in FIG. 5, when the toner adhesion amount to the patch on the sheet P increases, the image density of the patch also increases. For example, when the fixing temperature is set to be Ta within the real usable area and the toner adhesion amount is set to be X, the image density is Da. Here, when the fixing temperature is changed from the target temperature Ta to temperature Tb or Tc based on any variations in the installation condition of the image-forming apparatus, the image density considerably changes. Therefore, when adjusting the variations in the image density based on the variation in the fixing temperature by the toner adhesion amount, there may be a case where the adjustment by the toner adhesion amount is excessive or insufficient.

On the other hand, when the fixing temperature is set to be Td within the fixity saturation state and the toner adhesion amount is set to be X, the image density is Db. Here, when the fixing temperature is changed from the target temperature Td to temperature Te or Tf based on any variations in the installation condition of the image-forming apparatus, the image density does not change as compared with the case of the real usable area. Namely, when the toner adhesion amount is fixed in the fixity saturation state, the image density is univocally fixed without receiving any influence of the variation in the fixing temperature. Thus, in this embodiment, any accurate toner adhesion amount may be adjusted, by utilizing the image density in the fixity saturation situation, without receiving any influence of the variation in the fixing temperature.

[Operation Example of Image-Forming Apparatus]

Figure 6:
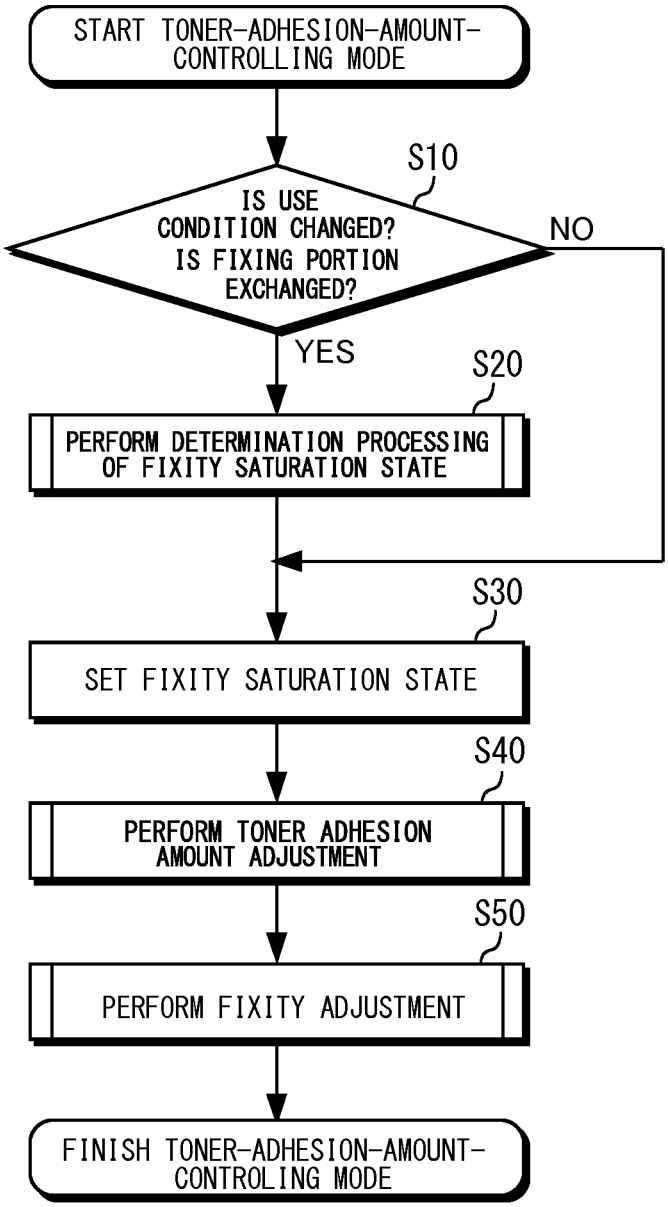
FIG. 6 is a flowchart showing an operation example of the image-forming apparatus in a first embodiment of this invention in a toner-adhesion-amount-controlling mode.

The following will describe an operation example of the image-forming apparatus 100 according to the first embodiment of this invention with reference to FIGS. 6 through 10. FIG. 6 shows an operation example of the image-forming apparatus 100 in the first embodiment of this invention in the toner-adhesion-amount-controlling mode. The toner-adhesion-amount-controlling mode starts by, for example, the selection of a mode-starting button displayed on the screen of the manipulation/display portion 70.

As shown in FIG. 6, at a step S10, when starting the toner-adhesion-amount-controlling mode, the controller 50 of the image-forming apparatus 100 judges whether or not a determination processing of fixity saturation state is performed to determine the fixing condition in which the image density of the patch is the fixity saturation state. For example, the controller 50 judges whether or not the determination processing of fixity saturation state is performed based on whether or not an installation environment of the image-forming apparatus 100 or a use condition such as use history thereof is changed from the former determination processing time of the fixity saturation state or the fixing portion 44 is exchanged. This is because the fixing conditions such as the fixing temperature are excessive when the image density of the patch is saturated so that a phenomenon so-called "hot off-set" in which the toner image transferred to the sheet P is too melted to be adhered to the fixing portion 44, not to the sheet P, which may exert any bad influence upon the fixing portion 44. This is also because it is desirable to decrease frequencies of fixing processing on the fixity saturation state as much as possible. Therefore, in this embodiment, the determination processing of fixity saturation state is performed only when an individual difference occurs in the fixing portion 44 or the use condition of the image-forming apparatus 100 is easy to vary and in this case, a new set value by which the image density is the fixity saturation state is determined. For example, the controller 50 newly sets the set value when the fixing portion is exchanged. When judging that it is desirable that the determination processing of fixity saturation state is performed, the controller 50 goes to a step S20. When judging that it is desirable that the determination processing of fixity saturation state is not performed, the controller 50 goes to a step S30.

Figure 7:
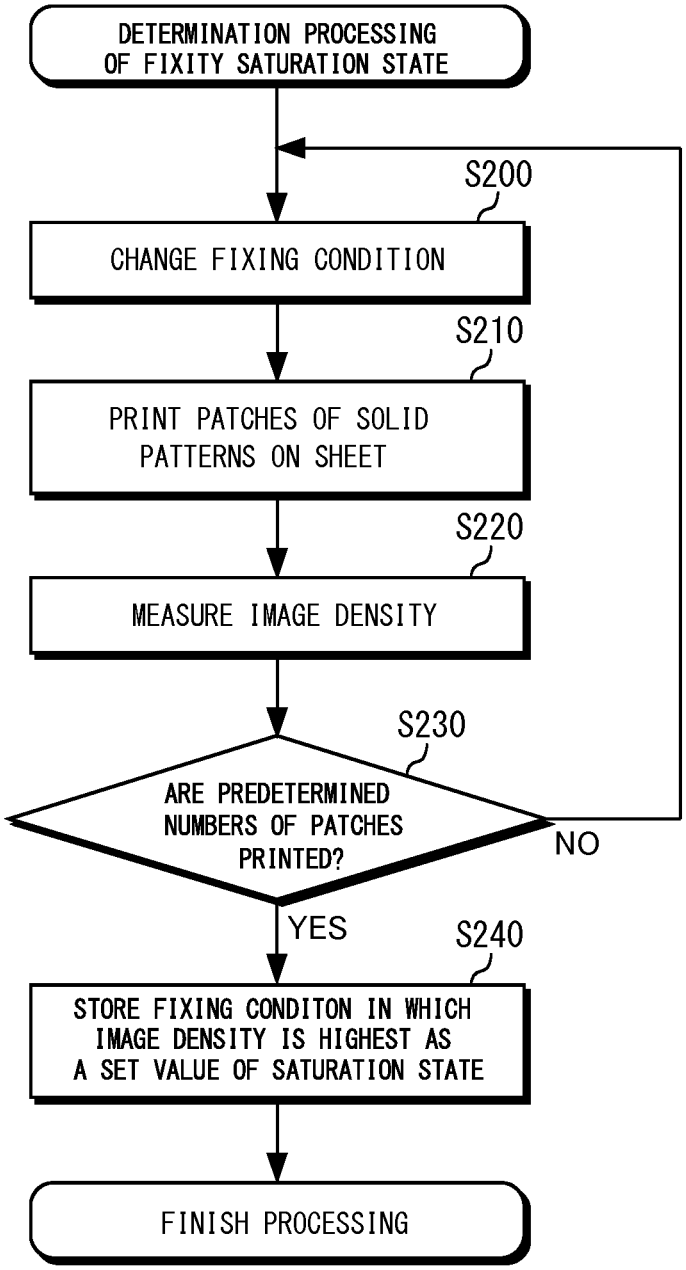
FIG. 7 is a flowchart showing an operation example of the image-forming apparatus in a determination processing of fixity saturation state.

At the step S20, the controller 50 performs the determination processing of fixity saturation state. FIG. 7 is a subroutine showing an operation example of the image-forming apparatus 100 in the determination processing time of fixity saturation state at the step S20. As shown in FIG. 7, at a step S200, the controller 50 changes fixing conditions such as the fixing temperature and pressure (nip pressure) of the fixing portion 44, and the transporting speed of the sheet P when the sheet P is passed through the fixing portion 44 because the fixity is settled by heat to be added to the toner. The fixing condition is set to such a value that, for example, the image density of the patch is the fixity saturation state.

At a step S210, the controller 50 controls the image-forming portion 10 and the like to print the patch(es) of solid patterns on the sheet P. In this embodiment, the controller 50 controls the image-forming portion 10 and the like to print the black patch(es) on the sheet P. The fixing portion 44 performs the fixing process on the patch transferred to the sheet P by the secondary transfer roller 34 under the fixing condition set at the step S200.

At a step S220, the image density sensor 120 measures the image density of the patch(es), which the fixing portion 44 fixes, on the sheet P and outputs to the controller 50 an output value (voltage value) based on an amount of received light that is obtained by the measurement. The controller 50 acquires the image density of the patch(es) based on the output value output from the image density sensor 120 and the storage portion 72 stores any information about the acquired image density of the patch(es). For example, the controller 50 acquires the image density of the patch from the output value using an output characteristics graph indicating the previously set relationship between the image density and the output value.

At a step S230, the controller 50 judges whether or not predetermined numbers (for example, three through five) of patches are printed on the sheet P. The controller 50 goes to a step S240 when it judges that the predetermined numbers of patches are printed on the sheet P. On the other hand, the controller 50 goes back to the step S200 when it judges that the predetermined numbers of patches are not printed on the sheet P. At the step S200, the controller 50 changes the fixing conditions, controls the fixing portion 44 to fix the patch(es) printed on the sheet P under the changed fixing conditions and controls the image density sensor 120 to measure the image density of the patch(es). Such processing is repeatedly performed until the predetermined numbers of the patches are printed.

At a step S240, the controller 50 judges that the fixing condition in which the image density is the highest image density among the obtained image densities of a plurality of patches is the fixing condition in which the image density of the patch is the fixity saturation state. The controller 50 judges that this fixing condition is settled as the set value when the image density of the patch is the fixity saturation state. Further, as the set value when the image density of the patch is the fixity saturation state, a value near the highest value of the image density may be used in addition to the highest value of the image density (see FIG. 4). Namely, it is possible to use the value as the set value if the fixing conditions are within a range in which the image density of the patch is not considerably changed based on the variations in the fixing conditions. The storage portion 72 stores the settled set value. When settling the set value of the fixity saturation state, the controller 50 goes back to the step S30 shown in FIG. 6.

At the step S30, the controller 50 reads the set values out of the storage portion 72 and sets the fixing temperature and pressure of the fixing portion 44, the transporting speed of the sheet P and the like based on the read set value. When the controller judges at the step S10 that the use conditions of the image-forming apparatus 100 are not changed, the controller 50 also reads the set value, which has been used before the variation in the use phenomenon of the apparatus or before the exchange of the fixing portion 44, out of the storage portion 72 and sets it as the fixing conditions.

Figure 8:
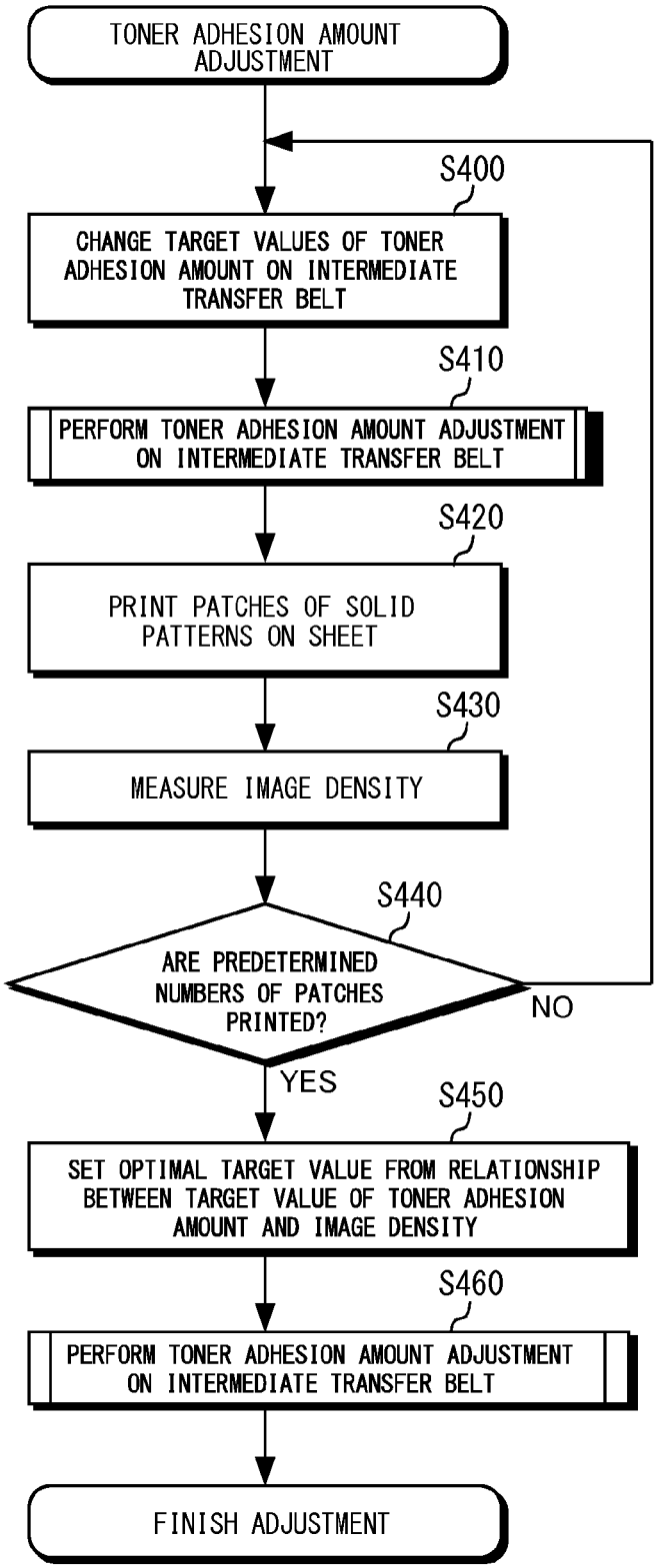
FIG. 8 is a flowchart showing an operation example of the image-forming apparatus in a toner adhesion amount adjustment.

At a step S40, the controller 50 performs a toner adhesion amount adjustment after the fixing conditions are set to a set value so that the image density of the patch is the fixity saturation state. FIG. 8 is a subroutine showing an operation example of the image-forming apparatus 100 in the toner adhesion amount adjustment time.

As shown in FIG. 8, at a step S400, the controller 50 changes a target value of the toner adhesion amount of the patch to be transferred to the intermediate transfer belt 8 (hereinafter, referred to as "target value of the toner adhesion amount on the intermediate transfer belt") or newly sets it. Further, when forming the second patches or more, the controller 50 changes the target value of the toner adhesion amount on the intermediate transfer belt 8 to other one which is different from that of the former patch forming time. For example, the controller 50 selects any desired target values of the toner adhesion amount on the intermediate transfer belt 8 by referring to a table in which plural target values of the toner adhesion amount on the intermediate transfer belt 8 have previously stored and set them as the target values of the toner adhesion amount on the intermediate transfer belt 8.

Figure 9:
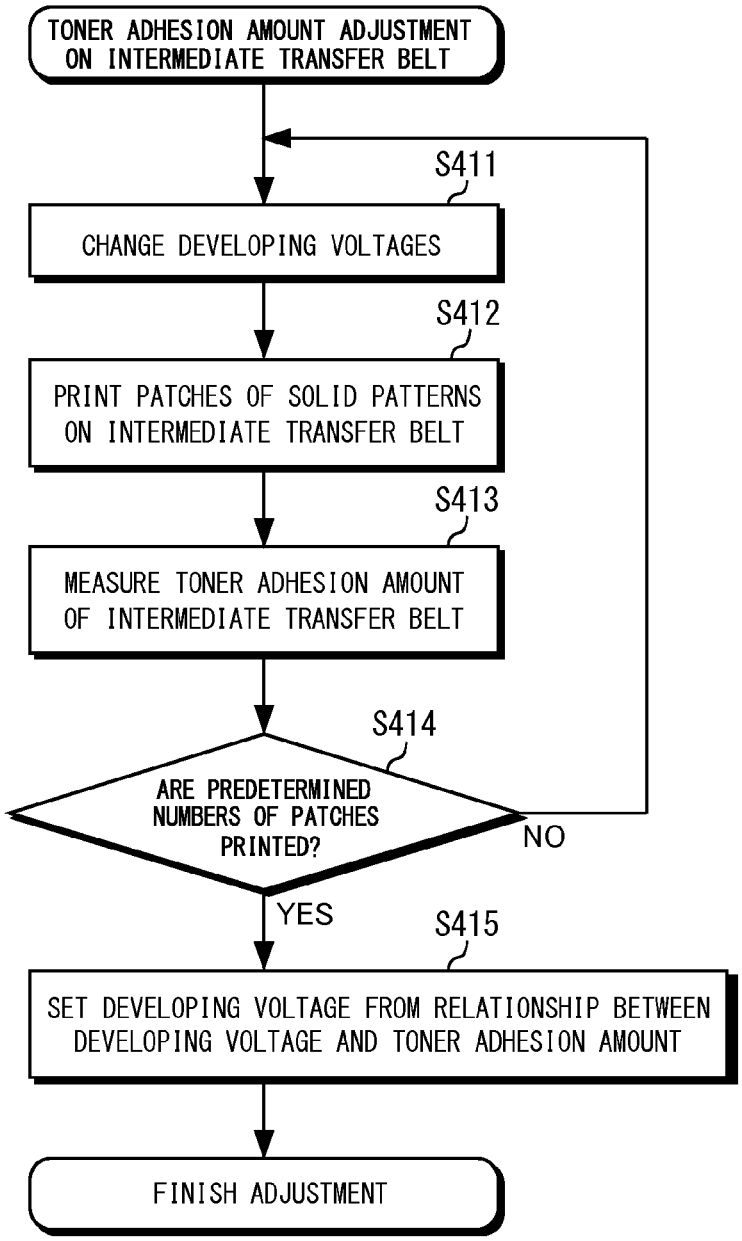
FIG. 9 is a flowchart showing an operation example of the image-forming apparatus in a toner adhesion amount adjustment on an intermediate transfer belt.

At a step S410, after the controller sets the target values of the toner adhesion amount on the intermediate transfer belt 8, the controller 50 performs a toner adhesion amount adjustment on the intermediate transfer belt 8 to adjust the toner adhesion amount of the patch(es) to be transferred on the intermediate transfer belt 8. FIG. 9 is a subroutine showing an operation example of the image-forming apparatus 100 in the toner adhesion amount adjustment time on the intermediate transfer belt 8. As shown in FIG. 9, at a step S411, the controller 50 changes developing voltages (image-forming conditions) in the developing portions 4. For example, the controller 50 selects desired developing voltages by referring to a table in which a plurality of developing voltages have been stored and sets them as the desired developing voltages.

At a step S412, the controller 50 controls the developing portions 4 and the like based on the changed developing voltages and control the transfer portion to transfer the patch(es) of solid patterns on the intermediate transfer belt 8. In this embodiment, the controller 50 controls the transfer portion to transfer the black patch(es) on non-image-forming area of the intermediate transfer belt 8.

At a step S413, the IDC sensor 110 detects the toner adhesion amount of the patch(es) formed on the intermediate transfer belt 8 and outputs to the controller 50 an output value based on the detected toner adhesion amount. The controller 50 acquires the toner adhesion amount of the patch(es) based on the output value output from the IDC sensor 110 and the storage portion 72 stores any information on the acquired toner adhesion amount.

At a step S414, the controller 50 judges whether or not predetermined numbers (for example, three through five) of patches are printed on the intermediate transfer belt 8. The controller 50 goes to a step S415 when it judges that the predetermined numbers of patches are printed on the intermediate transfer belt 8. On the other hand, the controller 50 goes back to the step S411 when it judges that the predetermined numbers of patches are not printed on the intermediate transfer belt 8. At the step S411, the controller 50 changes the developing voltages in the developing portions 4 and controls the transfer portion to transfer the patch(es), the toner adhesion amount of which is different from the former amount, on the intermediate transfer belt 8 under the changed developing voltages. Such processing is repeatedly performed until the predetermined numbers of the patches are transferred.

At a step S415, after the predetermined numbers of the patches are transferred, the controller 50 sets an optimal developing voltage that is the set target value of the toner adhesion amount on the intermediate transfer belt 8 from the relationship between the developing voltages in the developing portions 4 and the toner adhesion amount (output value) detected by the IDC sensor 110. For example, the controller 50 calculates an approximation from the developing voltage and toner adhesion amount acquired for every patch and sets the developing voltage corresponding to the target value of the toner adhesion amount on the intermediate transfer belt 8 from the calculated approximation. The controller 50 goes to a step S420 shown in FIG. 8 from the subroutine after the optimal developing voltage is set.

At the step S420, the controller 50 controls the developing portions 4 and the like to print the patch of solid patterns on the sheet P based on the developing voltage set at the step S415. In this embodiment, the controller 50 controls the developing portions 4 and the like to print the black patch(es) on the sheet P. The fixing portion 44 performs the fixing process on the patch(es) printed on the sheet P under the fixing conditions set at the step S30 so that the image density of the patch is the saturation state.

At a step S430, the image density sensor 120 measures the image density of the patch(es), which the fixing portion 44 fixes, on the sheet P and outputs to the controller 50 an output value based on the detected image density. The controller 50 acquires the image density of the patch(es) based on the output value output from the image density sensor 120 and the storage portion 72 stores any information about the acquired image density of the patch(es). For example, the controller 50 calculates the image density of the patch(es) from the output value acquired by the image density sensor 120 using an output characteristics graph (approximation) indicating the previously set relationship between the image density and the output value.

At a step S440, the controller 50 judges whether or not predetermined numbers (for example, three through five) of patches are printed on the sheet P. The controller 50 goes to a step S450 when it judges that the predetermined numbers of patches are printed on the sheet P. On the other hand, the controller 50 goes back to the step S400 when it judges that the predetermined numbers of patches are not printed on the sheet P. At the step S400, the controller 50 changes the target value of the toner adhesion amount on the intermediate transfer belt 8 and acquires the optimal developing voltage corresponding to the changed target value of the toner adhesion amount on the intermediate transfer belt 8. Such processing is repeatedly performed until the predetermined numbers of the patches are printed.

At the step S450, the controller 50 sets the optimal target value of the toner adhesion amount on the intermediate transfer belt 8 from the relationship between the target value of the toner adhesion amount on the intermediate transfer belt 8 and the image density of the patch(es) printed under this target value. For example, the controller 50 calculates the relationship between the target value of the toner adhesion amount on the intermediate transfer belt 8 and the image density, which are acquired for every patch, and acquires the target value of the toner adhesion amount on the intermediate transfer belt 8 corresponding to the image density as the target value thereof from the calculated relationship. As one example thereof, when describing it using FIG. 5, if the toner adhesion amount on the sheet P (the target value of the toner adhesion amount on the intermediate transfer belt 8) is X, the image density as the target value thereof can be set to Db.

At a step S460, after the controller 50 sets the optimal target value of the toner adhesion amount on the intermediate transfer belt 8, the controller 50 again performs the toner adhesion amount adjustment on the intermediate transfer belt 8 of the steps S411 through S415 shown in FIG. 9. This enables the optimal developing voltage corresponding to the target value of the toner adhesion amount on the intermediate transfer belt 8 acquired at the step S450 to be set and enables the toner adhesion amount of the image to be printed on the sheet P to be adjusted to the target value thereof. After the developing voltage is set, the controller 50 goes to a step S50 shown in FIG. 6.

Figure 10:
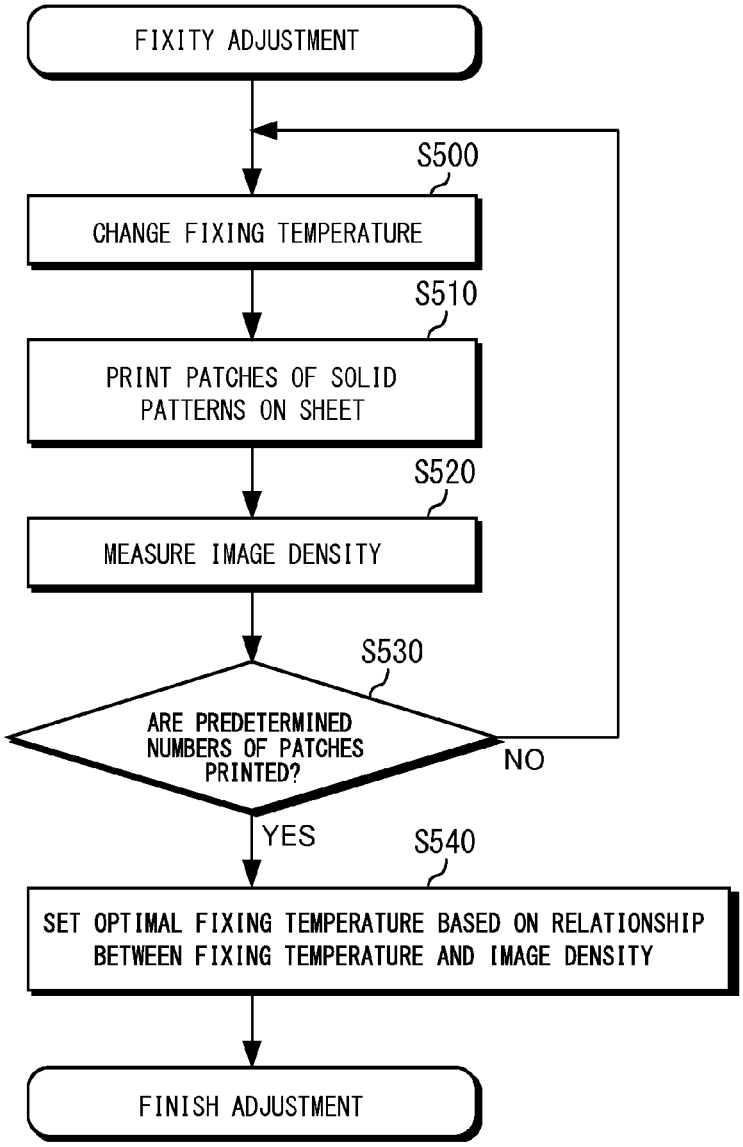
FIG. 10 is a flowchart showing an operation example of the image-forming apparatus in a fixity adjustment.

At the step S50, the controller 50 performs fixity adjustment. Namely, since the toner adhesion amount of the patch(es) on the sheet P can be set so as to be the target value thereof, the fixing temperature is next adjusted to a normal value thereof when the fixing temperature is different therefrom. FIG. 10 is a subroutine showing an operation example of the image-forming apparatus 100 in the fixity adjustment time at the step S50. As shown in FIG. 10, at a step S500, the controller 50 changes fixing temperature of the fixing portion 44. For example, the controller 50 changes the fixing temperature of the fixing portion 44 by referring to a table in which a plurality of fixing temperatures has been previously stored.

At a step S510, the controller 50 controls the image-forming portion 10 and the like to print the patch(es) of solid patterns on the sheet P. In this embodiment, the controller 50 controls the image-forming portion 10 and the like to print the black patch(es) on the sheet P. The controller 50 then sets the fixing conditions to the fixing temperature that is the target value in the real usable area which, for example, is used in the normal image-forming process time. This enables the fixing process to be performed on the patch(es) printed on the sheet P at the set fixing temperature.

At a step S520, the image density sensor 120 measures the image density of the patch(es), which the fixing portion 44 fixes, on the sheet P and outputs to the controller 50 an output value (voltage value) based on the detected image density. The controller 50 acquires the image density of the patch(es) corresponding to the output value output from the image density sensor 120 and the storage portion 72 stores any information about the acquired image density of the patch(es).

At a step S530, the controller 50 judges whether or not predetermined numbers (for example, three through five) of patches are printed on the sheet P. The controller 50 goes to a step S540 when it judges that the predetermined numbers of patches are printed on the sheet P. On the other hand, the controller 50 goes back to the step S500 when it judges that the predetermined numbers of patches are not printed on the sheet P. At the step S500, the controller 50 changes the fixing temperature, controls the fixing portion 44 to fix the patch(es) at the changed fixing temperature and controls the image density sensor 120 to measure the image density of the fixed patch(es). Such processing is repeatedly performed until the predetermined numbers of the patches are printed.

At a step S540, the controller 50 selects the fixing temperature corresponding to the target image density based on the relationship between the fixing temperature and the image density and sets it as the optimal fixing temperature. This enables the fixing temperature to be accurately adjusted. It is also possible to control the image density of the patch(es) so as to be its (their) set target value. Further, although the fixing temperature has been adjusted as the fixing conditions in this embodiment, the invention is not limited thereto: It is possible to adjust the nip pressure of the fixing portion 44 and/or the transporting speed of the sheet P.

As described above, since the image-forming apparatus 100 according to the first embodiment performs the toner-adhesion-amount-controlling mode at the fixing conditions so that the image density is the fixity saturation state, it is possible to control the toner adhesion amount accurately without exerting any influence of the variations in the fixing portion 44. This prevents generating any failure in fixing separation and the like when the toner adhesion amount is excessive. This also prevents generating any various kinds of failure in the image such as density unevenness, deterioration of graininess and the like when the toner adhesion amount is insufficient. A fixing control by a glossiness sensor is not required so that the costs therefor are reduced and miniaturization of the image-forming apparatus 100 can be realized.

Further, in the first embodiment, the toner-adhesion-amount-controlling mode according to this invention is not performed in all of the process variations in the transfer portion and/or the fixing portion 44. The toner-adhesion-amount-controlling mode is performed on the detection of the toner adhesion amount of the image on the sheet P and on the time when a factor influencing the fixity is changed and the like. Normally, the toner adhesion amount is controlled using the intermediate transfer belt 8. This prevents waste paper from being generated and productivity of the image-forming apparatus 100 from being reduced.

Additionally, in the first embodiment, since the fixity saturation state is set in a case where the individual difference varies when the fixing portion 44 is exchanged or the use condition of the image-forming conditions varies in the determination processing of the fixity saturation state of the toner-adhesion-amount-controlling mode, it is possible to reduce a case where the fixity is excessive. This avoids the off-set in which the toner is too molten so that it is adhered to the fixing portion 44, not the sheet P.

Second Embodiment

The following will describe an image-forming apparatus 100 according to a second embodiment of this invention in which the toner-adhesion-amount-controlling mode is performed without using any intermediate transfer belt 8. It is to be noted that other configurations and operations of this image-forming apparatus 100 according to the second embodiment are similar to those of the image-forming apparatus 100 according to the first embodiment so that like numbers indicate like components in this embodiment, the detailed description of which will be omitted.

The following will describe the operations of the image-forming apparatus 100 according to the second embodiment that performs the toner-adhesion-amount-controlling mode with reference to FIG. 6. The operations of the steps S10, S20, S30 and S50 shown in FIG. 6 are similar to those of the first embodiment and they will be briefly described.

First, at the step S10 shown in FIG. 6, the controller 50 judges whether or not a determination processing of fixity saturation state is performed to determine the fixing condition so that the image density of the patch is the fixity saturation state. When judging that it is desirable that the determination processing of fixity saturation state is performed, the controller 50 goes to the step S20. At the step S20, the controller 50 performs the determination processing of fixity saturation state and sets the fixing conditions in the fixing portion 44 so that the image density of the patch is the fixity saturation state.

Figure 11:
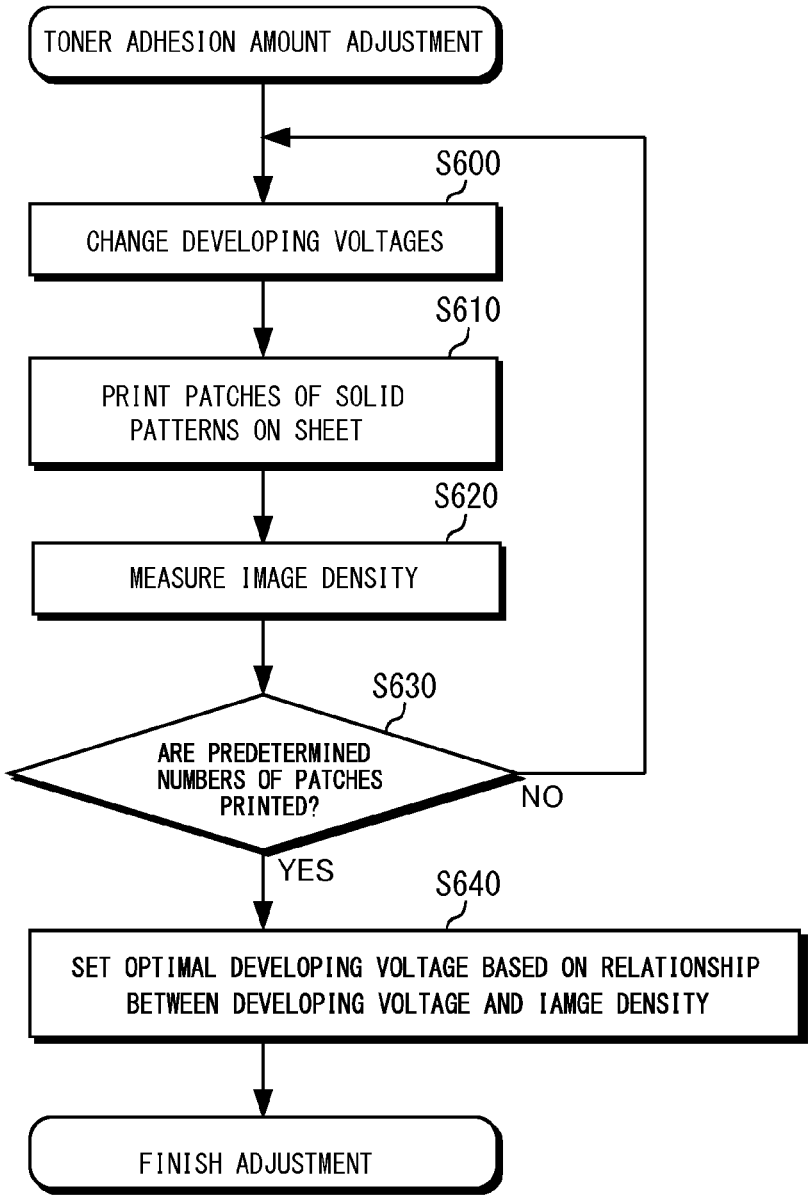
FIG. 11 is a flowchart showing an operation example of the image-forming apparatus in a second embodiment of this invention during the toner adhesion amount adjustment in the toner-adhesion-amount-controlling mode.

After the controller 50 sets the fixing conditions to the set values of the fixity saturation state, the controller 50 performs the toner adhesion amount adjustment. FIG. 11 is a subroutine showing an operation example of the image-forming apparatus 100 according to the second embodiment in the toner adhesion amount adjustment time. As shown in FIG. 11, at a step S600, the controller 50 changes developing voltages in the developing portions 4.

At a step S610, the controller 50 controls the developing portions 4 and the like based on the changed developing voltages and control the image-forming portion 10 and the like to print the patch(es) of solid patterns on the sheet P. This allows the fixing process to be performed on the patch(es) printed on the sheet P under the fixing conditions set at the step S30.

At a step S620, the image density sensor 120 detects the image density of the patch(es) formed on the sheet P, which the fixing portion 44 fixes, and outputs to the controller 50 an output value based on the detected image density. The controller 50 acquires the image density of the patch(es) based on the output value output from the image density sensor 120 and the storage portion 72 stores any information on the acquired image density of patch(es).

At a step S630, the controller 50 judges whether or not predetermined numbers (for example, three through five) of patches are printed on the sheet P. The controller 50 goes to a step S640 when it judges that the predetermined numbers of patches are printed on the sheet P. On the other hand, the controller 50 goes back to the step S600 when it judges that the predetermined numbers of patches are not printed on the sheet P. At the step S600, the controller 50 changes the developing voltages in the developing portions 4, controls the fixing portion 44 to fix the patch(es) printed on the sheet P based on the changed developing voltages, and controls the image density sensor 110 to detect the image density of the fixed patch(es). Such processing is repeatedly performed until the predetermined numbers of the patches are transferred.

At the step S640, the controller 50 sets an optimal developing voltage of the developing portions 4 from the relationship between the developing voltages in the developing portions 4 and the image density of the patch(es) printed under the developing voltages. For example, the controller 50 calculates an approximation from the developing voltage and the image density acquired for every patch and sets the optimal developing voltage corresponding to the target value of the image density (toner adhesion amount) using the calculated approximation. This enables the optimal toner adhesion amount to be acquired as the target value thereof on the sheet P.

The controller 50 then goes to the step S50 where the controller 50 sets the optimal developing voltage in the toner-adhesion amount adjustment and goes to the steps S500 through S540 shown in FIG. 10 where the controller 50 performs the fixity adjustment.

As described above, the image-forming apparatus 100 according to the second embodiment has the same effects as those of the first embodiment. Namely, according to this second embodiment, since the toner-adhesion-amount-controlling mode is performed at the fixing conditions so that the image density is the fixity saturation state, it is possible to control the toner adhesion amount accurately without exerting any influence of the variations in the fixing portion 44. This prevents generating any failure in fixing separation and the like when the toner adhesion amount is excessive. This also prevents generating any various kinds of failure in density unevenness, deterioration of graininess and the like when the toner adhesion amount is insufficient.

It should be understood by those skilled in the art that various modifications, combinations, sub-combinations and alterations may occur depending on design requirements and other factors insofar as they are within the scope of the appended claims or the equivalents thereof. Although, in the above-mentioned embodiments, the set value so that the image density is the fixity saturation state has been obtained when the toner-adhesion-amount-controlling mode is selected, this invention is not limited thereto: For example, any optimal set value so that the image density is the fixity saturation state may be acquired by an experiment; any optimal set value so that the image density is the fixity saturation state may be estimated from the past use conditions; the storage portion 72 may store these set values previously, before the shipment thereof. This allows the image density of the patch(es) to be saturation state even when the image-forming apparatus having less variation in its use condition performs any image-forming process. Thus, it is possible to control the toner adhesion amount accurately.

Further, although the developing voltages of the developing portions 4 have been adjusted in the toner adhesion amount adjustment on the intermediate transfer belt 8 to control the toner adhesion amount of the patch(es) formed on the sheet P, this invention is not limited thereto: For example, it is possible to control the toner adhesion amount of the patch(es) by adjusting at least one of the image-forming conditions such as voltage or current of the charging portions 2, voltage or current of the exposure portions 3, and voltage or current of the transfer portion such as the secondary transfer roller 34.

The invention claimed is:

1. An image-forming apparatus comprising:

an image-forming portion that forms a patch on a sheet, the patch being a toner image;

a fixing portion that fixes the patch formed by the image-forming portion on the sheet;

an image-density-detecting portion that detects an image density of the patch fixed by the fixing portion on the sheet; and a controller that controls the fixing portion to control a toner adhesion amount based on a detection result of the image density of the patch by the image-density-detecting portion, wherein the controller sets a fixing condition of the fixing portion in the control so that the image density of the patch is saturated and controls the fixing portion to control the toner adhesion amount based on the detection result of the image density of the patch by the image-density-detecting portion, the patch being formed under the set fixing condition.

2. The image-forming apparatus according to claim 1 wherein the controller controls the fixing portion to fix plural patches under different fixing conditions, and sets as a set value of the fixing condition in which the image density of the patch is saturated a fixing condition in which the image density is highest or approximate to the highest value of the plural patches detected by the image-density-detecting portion.

3. The image-forming apparatus according to claim 2 wherein the controller newly sets the set value when a use condition of the image-forming apparatus varies from a former setting time of the set value.

4. The image-forming apparatus according to claim 2 wherein the controller newly sets the set value when the fixing portion is exchanged.

5. The image-forming apparatus according to claim 1 wherein a set value of the fixing condition so that the image density of the patch is saturated is previously set.

6. The image-forming apparatus according to claim 1 wherein the fixing condition is at least one condition of a fixing temperature, pressure, and a transporting speed of the sheet during a passing time through the fixing portion.

7. The image-forming apparatus according to claim 1 wherein the image-forming portion contains a charging portion, a developing portion, an exposing portion and a transferring portion;

the controller controls the toner adhesion amount of the patch formed on the sheet by adjusting at least one condition of voltage/current in the charging portion, a developing voltage in the developing portion, voltage/current in the exposing portion, and voltage/current in the transferring portion.

8. The image-forming apparatus according to claim 1 wherein the image-forming portion contains an image carrier that carries the toner image and an adhesion amount detection portion that detects the toner adhesion amount of the patch formed on the image carrier; and the controller sets an image-forming condition based on the toner adhesion amount of the patch detected by the adhesion amount detection part, and then, controls the toner adhesion amount so that the toner adhesion amount on the image carrier is a set target value based on the image density of the patch formed under the set image-forming condition.

9. The image-forming apparatus according to claim 1 wherein the controller controls the toner adhesion amount and then, sets a fixing condition of the fixing portion based on detection results of the image densities of plural patches formed under plural fixing conditions so that the image densities of the patches are a set target value.

* * * * *